United States Patent [19]

Eheim, deceased

[11] Patent Number: 4,662,337

[45] Date of Patent: May 5, 1987

[54] FUEL INJECTION PUMP FOR INTERNAL COMBUSTION ENGINES

[75] Inventor: Franz Eheim, deceased, late of Stuttgart, Fed. Rep. of Germany, by Helga Eheim, heiress

[73] Assignee: Robert Bosch GmbH, Stuttgart, Fed. Rep. of Germany

[21] Appl. No.: 765,994

[22] Filed: Aug. 15, 1985

[30] Foreign Application Priority Data

Oct. 31, 1984 [DE] Fed. Rep. of Germany ..... 3439749

[51] Int. Cl.[4] ..... F02M 39/00

[52] U.S. Cl. ..... 123/450; 123/500; 123/357; 123/503; 417/462

[58] Field of Search ..... 123/450, 500, 357–359, 123/503, 501, 449; 417/462

[56] References Cited

U.S. PATENT DOCUMENTS

| | | | |
|---|---|---|---|
| Re. 23,889 | 10/1954 | Seaver | 123/450 |
| 2,674,236 | 4/1954 | Humber | 417/462 |
| 2,765,741 | 10/1956 | Hogeman | 123/450 |
| 2,775,233 | 12/1956 | Pischoff | 123/450 |
| 2,790,432 | 4/1957 | Shallenberg | 123/450 |
| 3,758,241 | 9/1973 | Eheim | 123/503 |
| 4,036,193 | 7/1977 | Komayashi | 123/357 |
| 4,499,883 | 2/1985 | Miyaki | 123/503 |

FOREIGN PATENT DOCUMENTS

| | | | |
|---|---|---|---|
| 1035970 | 8/1958 | Fed. Rep. of Germany | 123/450 |

*Primary Examiner*—Carl Stuart Miller

*Attorney, Agent, or Firm*—Edwin E. Greigg

[57] ABSTRACT

A fuel injection pump for internal combustion engines is proposed, which is embodied as a radial-piston/distributor pump, having an axially fixed and rotationally driven distributor, on the end of which that is remote from the drive and protrudes freely out of the distributor cylinder guiding the distributor an annular slide is disposed, which can be both rotated and axially displaced by means of adjusting drives. Both the quantity adjustment and control of the instant of injection are effected in a electrically controlled manner by relief openings provided on the distributor and control openings which are provided on the annular slide. All of the foregoing can be effected precisely on the end of the distributor which is free of moment.

16 Claims, 9 Drawing Figures

FIG. 6
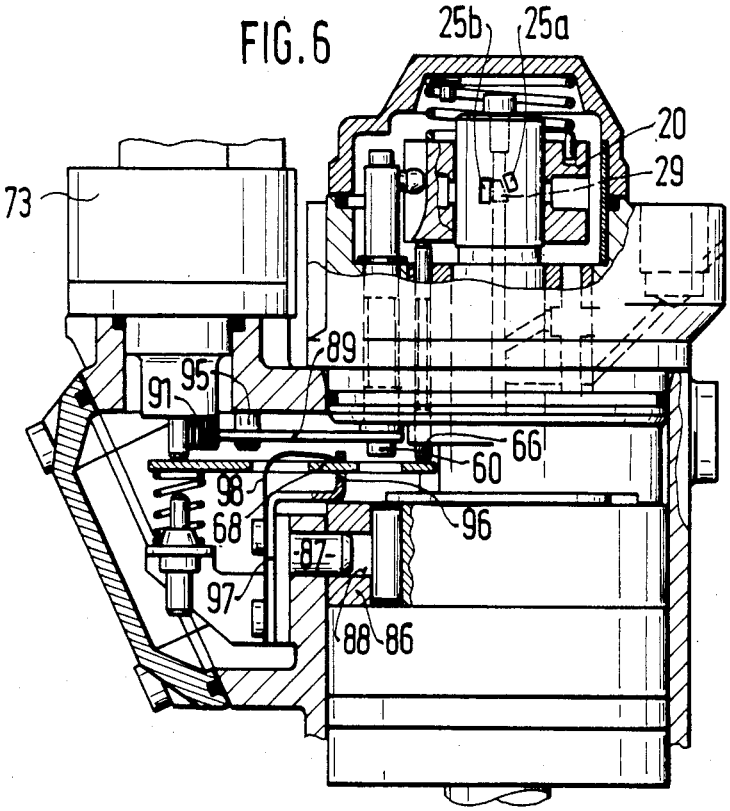
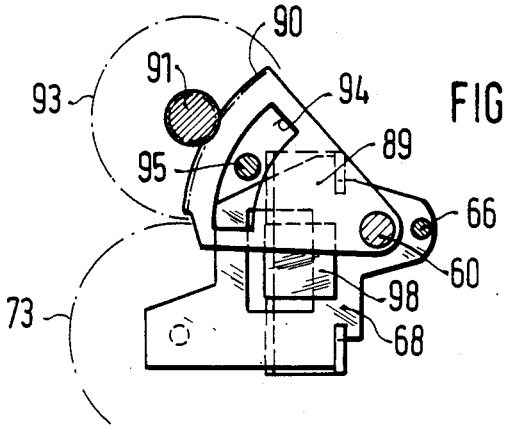
FIG. 7

FUEL INJECTION PUMP FOR INTERNAL COMBUSTION ENGINES

BACKGROUND OF THE INVENTION

The invention is directed to improvements in fuel injection pumps.

In a fuel injection pump of this type, known from German Pat. No. 1 035 970, the distributor merges, at its end that protudes out of the distributor cylinder on the drive side of the distributor, with a part having an enlarged diameter, in which the pump cylinders and pump pistons are disposed. This part includes the cam ring, on which roller tappets roll on its cam track that points radially inward; the roller tappets cause the pump pistons to execute a reciprocating movement. To this end, the distributor is driven by a pump drive shaft in synchronism with the rpm of the associated internal combustion engine. The drive shaft is integral with the distributor and disposed coaxially thereto. On the part of this shaft adjoining the part of the distributor having the enlarged diameter, there is an annular slide which has relief bores, each of which cooperate with triangular control openings on the jacket face of the distributor. These control openings communicate with the relief conduit. The annular slide is both axially displaceable and rotatable on the distributor by means of control members, and it is coupled with the cam ring via a bar in order to rotate the cam ring.

This fuel injection pump has the disadvantage that the annular slide is located between the part of the distributor having the pump pistons and the drive shaft. The distributor part on which the annular slide operates must therefore transmit the large drive moment for actuating the pump pistons and is exposed to oscillating forces in accordance with the number of cams on the cam track of the cam ring or the number of pumping strokes per revolution of this radial piston distributor pump. This distributor part must furthermore have a relatively large diameter. Because the rotation of the cam ring is effected via the annular slide, there are harmful consequences here too, which substantially affect the accuracy of control.

OBJECT AND SUMMARY OF THE INVENTION

It is a principal object of the invention to provide a fuel injection pump having the advantage over the prior art that the distributor on the other side of the pump piston drive is no longer exposed to torsional forces; thus the part of the distributor that contributes to control, and in particular its end bearing the annular slide, revolves in synchronism with the pump piston actuation.

It is another object to provide a means by which good, accurate adjustment of the annular slide and a good control result are assured.

It is yet another object to provide that the annular slide is very easily accessible for the purpose of adjustment or servicing.

It is still another object of the invention to provide a fuel injection pump that is slender in structure.

It is yet a further object to provide that fuel injection quantity control is favorably attained, without requiring feedback of the actual position of the annular slide, and accordingly the pump can be manufactured easily and economically.

Yet still another object of the invention, injection timing can be economically adjusted by means other than the known hydraulic timing device which rotates the cam ring. These novel means for achieving the same result provide for a revolving cam ring while the pump pistons are stationary.

It is still a further object of the invention that advantageously, the injection adjustment can be transmitted to the annular slide so that regardless of the injection adjustment the entire cam stroke is available for fuel quantity control purposes, and favorable cam lobe parts can be selected which are matched to the course of the injection quantity in the injection phases. The fuel injection pump embodied in this way has a high capacity for work and is capable of high performance.

In still another object of the invention, the intrinsically great expense for adjusting the cam ring by means of a timing device is avoided. The cam ring is fixed, and if embodied accordingly it can also rotate in synchronism with the pump drive shaft, and a device for rotating the annular slide can be provided which is controlled by a separate control motor. The triggering is advantageously effected by a stepping motor, which is triggered by an appropriately embodied control unit and can operate without feedback of the position of the annular slide.

The invention will be better understood and further objects and advantages thereof will become more apparent from the ensuing detailed description of preferred embodiments taken in conjunction with the drawings.

BRIEF DESCRIPTION OF THE DRAWINGS

FIG. 6 shows a partial sectional view of second exemplary embodiment of the invention with a radial-piston/distributor injection pump, the cam ring of which is rotationally fixed and axially secured, with two stepping motors for varying the axial and rotational position of the annular slide;

FIG. 7 is a partial plan view in greater detail of the device for rotating the annular slide in the exemplary embodiment of FIG. 6;

DESCRIPTION OF THE PREFERRED EMBODIMENTS

Figure 1:
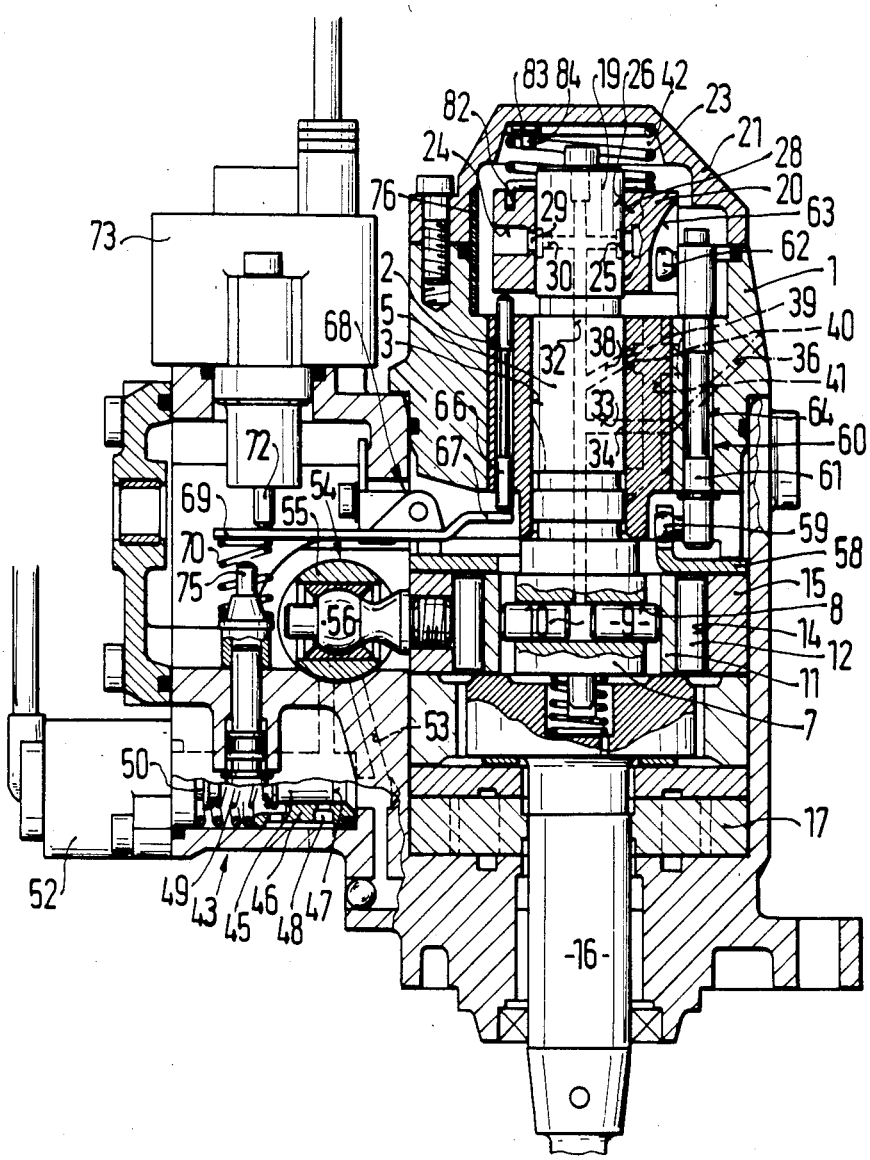
FIG. 1 shows a first exemplary embodiment of the invention, in a fragmentary section taken through a radial piston injection pump the cam ring of which is adjustable by means of an injection timing device.

All the exemplary embodiments are distributor fuel injection pumps of the radial piston type, having an injection pump housing 1, in which a cylinder liner 2 is inserted, the inner bore 3 of which is embodied as a distributor cylinder and guides a distributor 5, which protrudes out of the distributor cylinder at both ends. One of the protruding end parts 7 of the distributor has an enlarged diameter and has a diametrical through bore extending in a radial plane with respect to the distributor axis; the through bore forms two pump cylinders 8, in which two pump pistons 9 are tightly displaceable and between them, on the inside, enclose a pump work chamber 10. Instead of two pump pistons, a plurality of pump pistons may be provided instead, with a corresponding increase in the number of pump cylinders.

The pump pistons 9 rest on roller shoes 11, which have rollers 12 capable in turn of rolling on a cam track 14, pointing radially inward, of a cam ring 15. The cam ring 15 is rotatably supported in a cylindrical recess of the injection pump housing and is fixed in the axial direction. A drive shaft 16 is coupled to the end 7 of the distributor having the enlarged diameter of the distributor, and at the same time the drive shaft drives a fuel supply pump 17 which is disposed in the interior of the pump housing and the driven part of which is supported on the drive shaft 16.

An annular slide 20 is mounted in a sealing manner on the other, free end 19 of the distributor remote from the drive shaft 16 and protruding out of the distributor cylinder. A restoring spring 23 which tends to displace the annular slide toward the drive side is fastened between a lid 21 adjoining the pump housing on the free distributor end 19 and the annular slide 20. The annular slide has radial through bores 24, which lead to control openings 29, which open toward the inner jacket face 26 of the annular slide. The shape and distribution of these control openings are shown in various embodiments in FIGS. 2–5 and will be described in further detail below. In the operative range of these control openings 29, the distributor also has relief openings 25 on its outer jacket surface 28, which will also be described later in connection with the control openings. The relief openings 25 communicate via radial conduits 30 with a relief conduit 32, which from these conduits on takes the form of an axial connecting conduit leading to the pump work chamber 10.

Substantially medially of the distributor cylinder 3, a pressure conduit 33 branches off from the relief conduit and leads to a distributor opening 34, by way of which the pressure conduit 33 is made to communicate in alternation with injection lines 36 during the individual pumping strokes of the pump pistons, as the distributor rotates. These injection lines 36 discharge into the distributor cylinder 3 in the radial plane of the distributor opening and correspond in number and distribution to the cylinders of the engine that are to be supplied by this fuel injection pump.

A transverse conduit 38 also branches off from the relief conduit, leading to one or more fill openings 39 on the jacket face 28 of the distributor; these fill openings communicate with one or more inlet openings 40 of a fuel supply conduit 41 during the intake stroke, depending on the rotational position of the distributor. The fuel supply conduit communicates on the one hand with the diversion chamber 42 surrounding the free end 19 of the distributor and at the same time with the supply side of the fuel supply pump 17.

The fuel pumped by the fuel supply pump from a fuel supply container not otherwise shown here is controlled with the aid of a pressure control valve 43. The fuel supply pressure, which intrinsically rises with increasing pump rpm, can be formed and influenced in this way. In a known manner, the pressure control valve has a piston 45, which is displaceable in a cylinder 46 and is acted upon on one end face 47 by the fuel pressure from the supply side of the fuel supply pump and in accordance with the deflection of the piston uncovers a variably-sized cross section at a diversion bore 48. The other end face of the piston is acted upon by a restoring spring 49, the initial spring tension of which is adjustable. In particular, in the exemplary embodiment now being described, the support point 50 integral with the housing is embodied as a spring plate that is adjustable by a stepping motor 52, so that arbitrarily adjustable restoring forces act upon the piston, triggered by an appropriate electronic control, and correspondingly arbitrary control pressure can be established on the pressure side of the supply pump 17.

The control pressure, formed in accordance with rpm, is carried via a pressure line 53 to an injection timing device 54, which in a known embodiment and with the aid of an injection timer piston 55 acted upon by this control pressure counter to a restoring force adjusts the rotational position of the cam ring 15 via a coupling tang 56. With this arrangement, every engine condition including the warmup phase can be taken into account.

A coupling part 58 is arranged to be engaged by a second crank lever 59 of a crank drive 60 and arranged to be secured on the cam ring 15. The second crank lever 59 is connected to a shaft 61, which is supported parallel to the axis of the distributor in the housing. On the other end of the crank drive shaft, this shaft protrudes into the diversion chamber 42, where it has a first crank lever 62, which engages a longitudinal groove 63 on the annular slide 20. The shaft 61 is guided tightly in the housing to avoid vibration, and medially thereof a reduction in diameter 64 is provided to improve lubrication and protect against corrosion and rust.

Also protruding into the diversion chamber 42 is an adjusting pin 66, which is likewise tightly but displaceablely disposed in the cylinder liner 2 parallel to the axis of the distributor so as to rest with its head on the lower end face of the annular slide 20. This adjusting pin is also given a relieved diameter in order to reduce corrosion or the formation of rust and to improve lubrication. On the opposite end, the arm 67 of a lever 68 rests on the adjusting pin. The lever 68 is supported integrally with the housing, and its other arm 69 is engaged on one side by a restoring spring 70 and on the other by the actuating piston 72 of an adjusting drive 73. This adjusting drive, in this exemplary embodiment, is an electrical linear stepping motor, but other electrically controlled or actuated final control elements such as magnetic final control elements could take its place. The restoring spring 70 is supported by being fixed on the housing. To positively fix an outset position, an adjustable stop 75 is provided, which at the same time serves to reset the linear stepping motor. At this stop, the outset position of the stepping motor is reproduced once again, in the event that any errors whatever result in partial or complete failure of the motor to execute adjusting steps.

The drive shaft 16 sets the distributor 2 into a rotation that is in synchronism with the engine. The pump pistons are moved inward and outward in accordance with the cam distribution. Upon an outward movement of the pump pistons in accordance with an intake stroke, the fill opening 39 communicates with the fuel supply conduit 41, so that the pump work chamber is completely filled with fuel, in accordance with the amplitude of the outward movement of the pump pistons or the amplitude of the cam track. If the rollers 12 then roll onto a succeeding cam lobe, the pump pistons are moved inward again, and they pump fuel via the relief conduit 32, the radial conduits 30 having relief openings 25 and the control openings 29 into the diversion chamber until such time as the relief openings 25 are closed. From this point on, the pressure in the pump work chamber increases up to the injection opening pressure, and the pump pistons pump the compressed fuel via the pressure conduit 33 and the distributor opening 34 into the particular injection line 36 uncovered by the distributor opening 34, via which injection line the fuel reaches the injection location. The high-pressure pumping lasts until such.time as a relief opening 25 comes to coincide with one of the control openings on the annular slide 20 and opens it, causing the pump work chamber to be relieved toward the diversion chamber 42. The diversion chamber is protected from cavitation that would be caused by the fuel emerging from it by the hardened steel ring 76 inserted in the housing.

Figure 2:
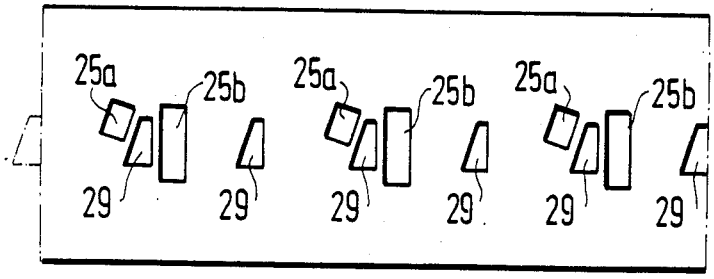
FIG. 2 is a two dimensional representation of the 3 dimensional cylindrical end of the distributor cooperating with the annular slide and of the inner cylinder of the annular slide which has the control openings and relief openings, shown by way of example in a six-cylinder injection pump.
Figure 3:
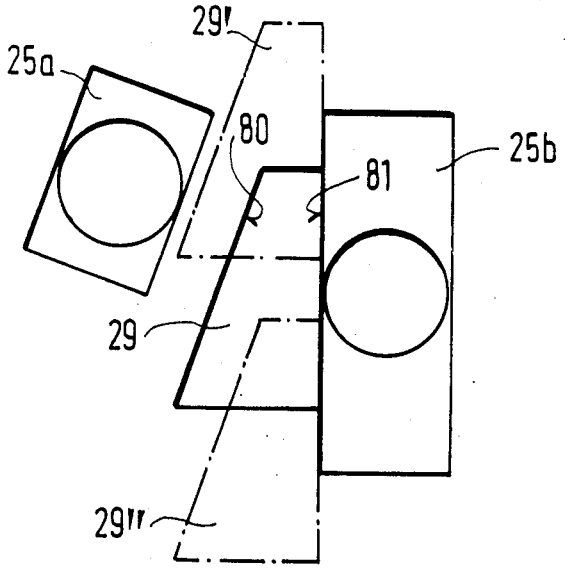
FIG. 3 illustrates an enlarged view for the alternative fuel quantity control possibilities of the invention, taking one control location as an example.

The quantity control with the aid of the annular slide 20 will now be explained in greater detail, referring to FIGS. 2 and 3. In FIG. 2, a two dimensional representation of both the inner jacket face 26 and the jacket face 28 of the distributor is shown as well as the relief openings 25*a* and 25*b* and the control openings 29 of the annular slide. Taking a six-cylinder distributor injection pump as an example, six trapezoidal control openings 29 are provided on the jacket face 26 of the annular slide, having a first limiting edge 80 inclined toward the axial direction of the distributor and a second limiting edge 81 parallel to the axis of the distributor. The distributor, contrarily, has three pairs of relief openings 25*a* and 25*b*, the first relief opening 25*a* being a longitudinal groove arranged parallel to the first limiting edge 80 and the second relief opening 25*b* being a longitudinal groove arranged parallel to the second limiting edge 81. The longitudinal grooves 25*a* and 25*b*, or the limiting edges 80 and 81, are inclined with respect to one another such that they converge toward the end of the distributor. Depending on the axial position of the annular slide, the control openings 29 fill the interspace between the relief openings 25*a* and 25*b* to a variable extent, which can be seen from FIG. 3. FIG. 3 shows the relative positions of the control openings and the relief opening for stopping, for full load and for an increased starting quantity. In the illustrated embodiment, the control opening 29, which will next move toward the left, has just come from the zone of overlap with the relief opening 25*b*, so that the fuel now pumped, after attaining the injection pressure, can be injected. This takes place until such time as the first limiting edge 80 coincides with the relief opening 25*a*. Over this rotational range FD, fuel can be supplied, and over the remainder of the cam stroke the fuel pumped by the pump piston flows back to the diversion chamber without being injected. In the stopping position, the annular slide is adjusted downward, so that the control opening reaches the position 29'. Over the small remaininq rotational range shown in the drawinq, the maximum that can happen is the enlarging of the dead space between the pump work chamber and the injection location, but without the opening pressure of the injection nozzle being exceeded. In the starting position, contrarily, the annular slide 20 is adjusted all the way upward to the end of the distributor, so that the control opening 29 reaches the position 29'' relative to the relief openings 25. Once the control opening 29' has left the zone of overlap with the opening 25*b*, all the fuel the pump piston is capable of pumping is subsequently injected, since the control opening is located outside the area of overlap with the shorter relief opening 25*b*.

Since in this illustrated example the relief opening 25*b* is aligned parallel to the axis of the distributor and the second limiting edge 81 of the control opening is likewise axially parallel therewith, the supply onset does not vary as a result of longitudinal displacement of the annular slide 20.

Figure 4:
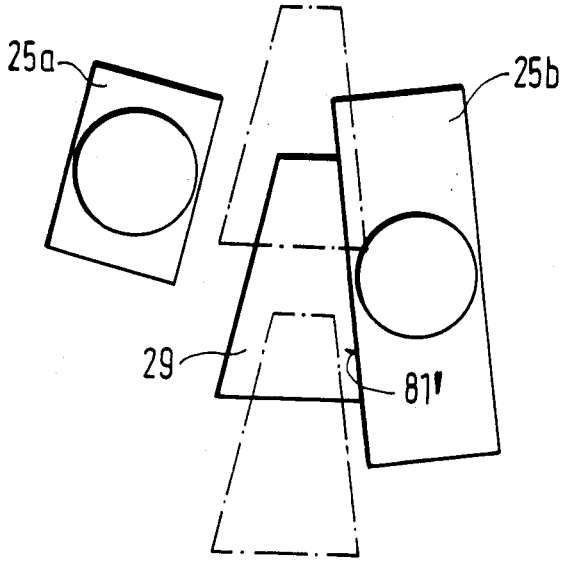
FIG. 4 illustrates the fuel quantity control and the load-dependent injection onset variation toward "late" injection that is attainable again, taking a single control location as an example.
Figure 5:
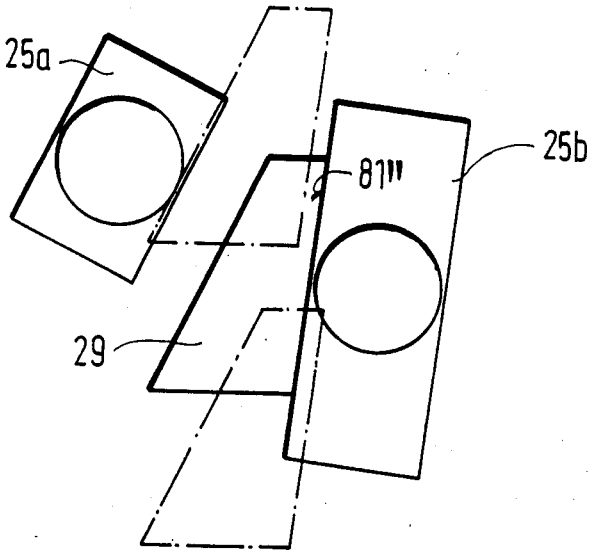
FIG. 5 shows the load-dependent supply onset shift toward "early" injection provided by a correspondingly different inclination of the control edges of a single control location as an example.

In other embodiments, such as in FIGS. 4 and 5, however, a variation of the supply onset can be effected by the longitudinal displacement of the annular slide. In the exemplary embodiment of FIG. 4, with an inclination of the second limiting edge 81' counter to the rotational direction of the distributor, a variation of the supply onset which shifts increasingly toward "early" with increasing load is attained. In FIG. 5, an embodiment is shown in which the second limiting edge 81'' is inclined in the rotational direction. By means of this embodiment, a shift of the supply onset toward "late" with increasing load is attained. Additionally, the cross sections of the bore 38 and/or the cross sections 39 and 40, if adapted appropriately to one another, can influence the fuel quantities or the control of the fuel injection time.

In addition to this load-dependent control of injection onset, an rpm-dependent control is provided, which is effected by the rotation of the annular slide. Here the governor slide [see above] goes along with the rotational movement imposed on the cam ring 15 by the injection timinq device 54. In this manner, the entire cam stroke can be exploited for pumping the fuel, since despite an adjustment in the injection timing, the supply can begin at the same point on the cam lobe.

The axial displacement of the annular slide is brought about by the adjusting movement of the adjusting pin 66, which is actuated by means of the lever 67. The lever 67 can be embodied as a one-armed lever, or advantageously as a two-armed lever, and is moved by the adjusting drive 73; the restoring spring 70, which acts upon the lever 69, acts in the same direction as the restoring spring 23 which engages the annular slide 20. The restoring spring 23 here has both an axial and a radial component, because with one end 82 it engages a recess in the annular slide 20 and with its other end 83 it is fixed in the rotational direction on a stop 84 on the housing lid 21. By being rotationally fixed, the annular slide has a play-free contact of the first crank lever 62 in the longitudinal groove 63. Naturally, instead of the limiting edges 81-81'' being inclined as described, the longitudinal groove 63 can be inclined accordingly, so that with the axial displacement of the annular slide 20, a similar adjustment of the injection onset is effected.

The second exemplary embodiment according to FIG. 6 is identical in structure, in its essential parts, to that of FIG. 1, so the description of FIG. 1 applies in this respect. Differing from the exemplary embodiment of FIG. 1, however, the cam ring 86 here is also fixed in the rotational direction by means of a bolt 87, which is inserted into the housing wall and protrudes into a radial bore 88. To this end, an injection timing adjustment is provided by rotating the annular slide 20, this rotational adjustment being effected by means of a crank drive 60. In this concept, however, the second crank lever 89 is now embodied as a segment of a gear wheel, as may be seen in FIG. 7. A pinion 91 which is connected to the drive shaft of a second electrically controlled control motor 93 engages the spur gear 90. This control motor 93 may also be a rotary stepping motor, for instance, or else embodied appropriately as in the present exemplary embodiment. Instead of a pinion drive, a worm drive can also be used. The stepping motor 93 in the exemplary embodiment of FIG. 6 is located parallel to the distributor axis and beside the first adjusting drive 73 which is aligned in the same way. As a result, a compact structure is attained, which is further enhanced by locating the adjusting pin 66 and the crank drive 60 axially parallel to one another. As a result, the fuel injection pump is relatively slender in structure, despite the adjusting drives provided for control purposes. To reset or fix the outset position of the second electrically controlled control motor 93, the crank lever 89 has a recess 94 in the form of a partial slot, through which a stop pin 95 which is attached to the housing and is adjustable protrudes.

In the exemplary embodiment of FIG. 6, the lever 68 is supported via a knife edge 96 on a bearing block 96. To assure the freedom from play and the fixation, the lever 68 is pressed against the knife edge 96 by a leaf spring 98. This form of embodiment reduces friction losses and hysteresis.

The exemplary embodiment described here otherwise functions identically to the exemplary embodiment of FIG. 1, except that a portion of the cam stroke that is available is required for injection timing adjustment. The annular slide, with its control openings 29 and the distributor, with its relief openings 25*a* and 25*b*, are embodied in the same manner as in FIG. 1.

Figure 8:
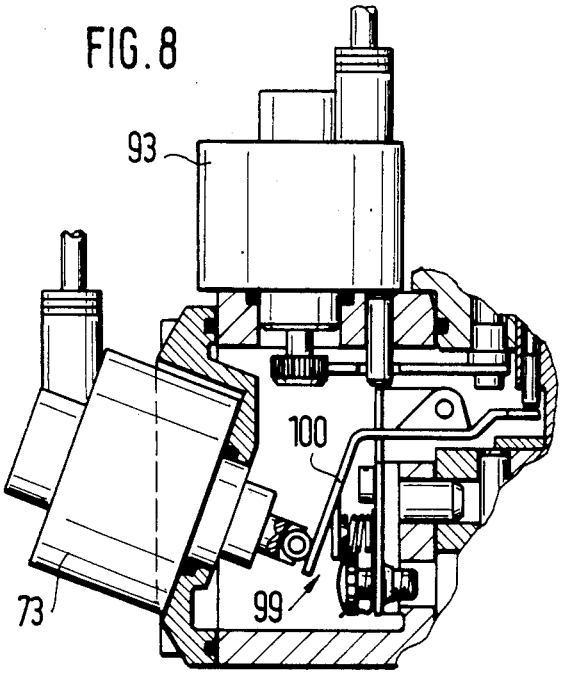
FIG. 8 shows a partial sectional view of a third exemplary embodiment of the invention, in a modification of the exemplary embodiment of FIG. 6 wherein the control motor for the quantity adjustment is laterally located.

In FIG. 8, a variant of the exemplary embodiment of FIG. 6 is shown, in which the lever that in FIG. 6 was embodied as an elongated lever 68 is here embodied as a bell crank 99. Because of this fact, the first adjusting drive 73 can be built onto the pump housing laterally, in accordance with the inclination of one lever arm 100 of this lever, and the second electrically controlled control motor 93 can be provided in the same sectional plane for controlling the injection onset as in FIG. 6. Because the change is merely in the details, only a portion of the fuel injection pump is shown here.

Figure 9:
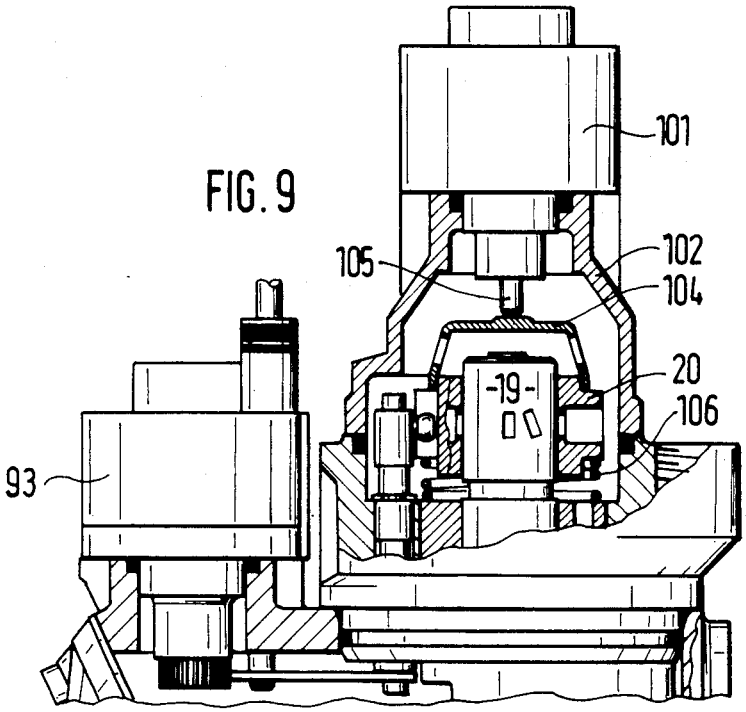
FIG. 9 shows a partial sectional view of a fourth exemplary embodiment of the invention, having an axially disposed control motor for the axial displacement of the annular slide in order to adjust the quantity.

The exemplary embodiment of FIG. 9, too, is a further development of the exemplary embodiment of FIG. 6. The change made here can also be realized in the other exemplary embodiments. Differing from the exemplary embodiment of FIG. 6, the first adjusting drive 101 here is disposed coaxially with the distributor axis, specifically in the lid 102, which corresponds to the lid 21 of the exemplary embodiments of FIGS. 1 and 6. Instead of the adjusting pin 66 and the lever 68, the annular slide 20 is provided with a bracket-like element 104 here, which surrounds the free end of distributor 19 and element 104 is arranged to engage the upper wall of the annular slide. Correspondingly, the restoring spring 23 provided in FIG. 1 is disposed here in the form of a restoring spring 106 on the opposite end of the annular slide, so that by means of the actuating bolt 105 the annular slide is displaced counter to the force of the restoring spring 106, which is embodied as a compression spring. This has the advantage of providing for a minimum play in the actuation of the annular slide and in order for the annular slide to effect quantity adjustment, as well as also having the advantage of resulting in a very slender structure of the fuel injection pump. Otherwise, the fuel injection pump of FIG. 9 functions the same as that of FIG. 6.

The foregoing relates to preferred exemplary embodiments of the invention, it being understood that other variants and embodiments thereof are possible within the spirit and scope of the invention, the latter being defined by the appended claims.

It is claimed:

1. A fuel injection pump for internal combustion engines comprising a housing having at least one pump piston actuated via a cam ring having a trackway, said piston adapted to enclose a pump work chamber in a pump cylinder, said pump cylinder being disposed in a distributor having an axis, a jacket face and being arranged to be driven rotationally in a distributor cylinder, said pump work chamber adapted to communicate with a relief conduit in said distributor, a pressure conduit arranged to extend between said jacket face and said relief conduit, fuel lines leading to said jacket face, said relief conduit further arranged to communicate with at least one relief opening controlled by an annular slide disposed on a free end of said distributor protruding out of said distributor cylinder, said annular slide further including at least one control opening and further being adapted for rotational and axial displacement by an adjusting means to control injection of fuel, said at least one control opening being provided with first and second linear limiting edges adapted to converge toward said free end of said distributor, said at least one control opening further being adjustable axially of said distributor jacket, said annular slide further being axially preloaded by a helical spring arranged coaxially with the axis of said distributor between said housing and said annular slide against a pin means supported in said housing, said pin means further having an axis and being actuatable via a lever by an adjusting drive means to axially adjust said annular slide, said annular slide further including a guide groove and a crank drive in continuous engagement with said annular slide by means of which said annular slide can be rotated against a circumferential preload of said helical spring, said crank drive further including a first crank lever which is adapted to continuously engage said guide groove on said annular slide, a shaft guided parallel to said distributor axis and a second crank lever connected to an adjusting drive, whereby an axial displacement of said annular slide is adapted to vary a duration of high-pressure pumping of said pumping piston, and the rotational displacement of said annular slide is adapted to vary an instant of injection of at least one fuel injection valve.

2. A fuel injection pump for internal combustion engines comprising a housing having at least one pump piston actuated via a cam ring having a trackway, said piston adapted to enclose a pump work chamber in a pump cylinder, said pump cylinder being disposed in a distributor having an axis, a jacket face and being arranged to be driven rotationally in a distributor cylinder, said pump work chamber adapted to communicate with a relief conduit in said distributor, a pressure conduit arranged to extend between said jacket face and said relief conduit, fuel lines leading to said jacket face, said relief conduit further arranged to communicate with at least one relief opening controlled by an annular slide disposed on a free end of said distributor protruding out of said distributor cylinder, said annular slide further including at least one control opening and further being adapted for rotational and axial displacement by an adjusting means to control injection of fuel, said at least one relief opening being provided with first and second linear limiting edges adapted to converge toward said free end of said distributor, said first linear limiting edge being disposed parallel to at least one lateral edge of a first control opening and said second linear limiting edge being disposed parallel to at least one lateral edge of a second control opening, said at least one control opening further being adjustable axially of said distributor jacket, said annular slide further being axially preloaded by a helical spring arranged coaxially with the axis of said distributor between a lid of said housing and said annular slide against a pin means supported in said housing, said pin means further having an axis and being actuatable via a lever by an adjusting drive means to axially adjust said annular slide, said annular slide further including a guide groove and a crank drive in continuous engagement with said annular slide by means of which said annular slide can be rotated against a circumferential preload of said helical spring, said crank drive further including a first crank lever which is adapted to continuously engage said guide groove on said annular slide, a shaft guided parallel to said distributor axis and a second crank lever connected to an adjusting drive, whereby an axial displacement of said annular slide is adapted to vary a duration of high-pressure pumping of said pumping piston, and the rotational displacement of said annular slide is adapted to vary an instant of injection of at least one fuel injection valve.

3. A fuel injection pump as defined by claim 1, further wherein said annular slide is urged in an upward direction by a spring means and said annular slide further being urged downwardly by means of an adjusting drive means.

4. A fuel injection pump as defined by claim 3, further wherein said annular slide has a longitudinal displacement which serves to vary the duration of the high-pressure pumping of said pump piston, and said instant of injection is variable by means of said rotational device.

5. A fuel injection pump as defined by claim 1, further wherein said lever is acted upon directly by a restoring spring, said lever further adapted to be adjusted, counter to the force of said spring, by a first electrically controlled control motor having an axis.

6. A fuel injection pump as defined by claim 1, further wherein said first control motor is an electric stepping motor.

7. A fuel injection pump as defined by claim 1, further wherein said first control motor is disposed parallel to said axis of said distributor.

8. A fuel injection pump as defined by claim 5, further wherein said lever has an axis said lever further embodied as a bell crank and said control motor axis is inclined relative to said axis of said adjusting pin.

9. A fuel injection pump as defined by claim 4, further wherein said rotating device is embodied as a crank drive, said crank drive further including a first crank lever which engages said guide groove on said annular slide, a shaft guided parallel to said distributor axis and a second crank lever connected to an adjusting drive for controlling said instant of injection.

10. A fuel injection pump as defined by claim 5, further wherein said rotating device is embodied as a crank drive, said crank drive further including a first crank lever which engages said guide groove on said annular slide, a shaft guided parallel to said distributor axis and a second crank lever connected to an adjusting drive for controlling said instant of injection.

11. A fuel injection pump as defined by claim 6, further wherein said rotating device is embodied as a crank drive, said crank drive further including a first crank lever which engages said guide groove on said annular slide, a shaft guided parallel to said distributor axis and a second crank lever connected to an adjusting drive for controlling said instant of injection.

12. A fuel injection pump as defined by claim 1, further wherein said second crank lever is connected to a cam ring, which is rotatable relative to said axis of said distributor by means of a control motor.

13. A fuel injection pump as defined by claim 1, further wherein said cam ring is fixed in an axial direction and said control motor is a hydraulic injection timing device, said hydraulic injection timing device arranged to be acted upon by an adjusting pressure which varies in accordance with rpm and which can be affected by means of a pressure control valve, said pressure control valve adapted to be controlled by a stepping motor.

14. A fuel injection pump as defined by claim 1, further wherein said second crank lever is connected to a second electrically controlled control motor.

15. A fuel injection pump as defined by claim 14, further wherein said second crank lever is embodied as a segment of a gear wheel, said gear wheel further having teeth which mesh with a drive means affixed on said shaft of the second control motor.

16. A fuel injection pump as defined by claim 15, further wherein said second control motor is an electric stepping motor.

* * * * *